United States Patent [19]

Gordon

[11] Patent Number: 4,950,838

[45] Date of Patent: Aug. 21, 1990

[54] ELECTRICAL CONNECTOR

[75] Inventor: Gregg Gordon, Manchester, N.H.

[73] Assignee: Burndy Corporation, Norwalk, Conn.

[21] Appl. No.: 371,033

[22] Filed: Jun. 26, 1989

[51] Int. Cl.[5] ..... H01R 11/28

[52] U.S. Cl. ..... 174/94 R; 29/515; 29/873; 174/71 R; 174/84 C; 174/90; 403/278; 403/281; 403/285; 439/880; 439/882

[58] Field of Search ..... 174/71 R, 84 C, 90, 174/94 R; 403/274, 278–281, 285, 385; 24/115 A, 129 W; 29/515, 517, 872, 873; 439/877, 880, 882

[56] References Cited

U.S. PATENT DOCUMENTS

| | | | |
|---|---|---|---|
| 1,631,719 | 6/1927 | Chandler | 403/283 |
| 2,930,113 | 3/1960 | Greco | 29/872 |
| 2,956,108 | 10/1960 | Brenner | 174/94 R |
| 3,053,930 | 9/1962 | Mallanik et al. | 174/94 R |
| 3,156,764 | 11/1964 | Toedtman | 174/94 R |
| 3,235,654 | 2/1966 | Eldridge, Jr. | 174/94 R |
| 3,236,938 | 2/1966 | Toedtman | 174/94 R |
| 3,354,517 | 11/1967 | Levinsky | 403/275 |
| 3,387,080 | 6/1968 | Dibble et al. | 174/94 R |
| 3,408,455 | 10/1968 | Dannes | 174/94 R |
| 3,546,366 | 12/1970 | Toedtman | 174/94 |
| 3,746,777 | 7/1973 | Peek | 174/94 R |
| 4,087,889 | 5/1978 | Ohba et al. | 29/129 W |
| 4,310,719 | 1/1982 | Cross et al. | 174/94 R |
| 4,350,843 | 9/1982 | Campbell et al. | 174/94 R |
| 4,405,827 | 9/1983 | Mixon, Jr. | 174/94 R |
| 4,438,958 | 3/1984 | De Cenzo | 174/94 S X |
| 4,723,921 | 2/1988 | Pooley | 439/783 |
| 4,734,062 | 3/1988 | Goto | 439/783 |

FOREIGN PATENT DOCUMENTS

| | | | |
|---|---|---|---|
| 1430116 | 3/1976 | United Kingdom | 439/880 |
| 1434954 | 5/1976 | United Kingdom | 174/94 R |

*Primary Examiner*—Morris H. Nimmo

*Attorney, Agent, or Firm*—Mitchell B. Wasson; Martin P. Hoffman; Burtsell J. Kearns

[57] ABSTRACT

An electrical connector for connecting a first conductor to a second conductor. The electrical connector includes a generally E-shaped body which defines first and second conductor receiving cavities for accommodating the respective conductors. An intermediate member extends generally centrally in the interior of the body member, serving to separate the conductor receiving cavities. The body member is provided with an opening communicating with the conductor receiving cavities, by means of which the conductors are adapted to be positioned within the cavities. A plurality of rib members project from the body member into each of the cavities, and are deformable under pressure to vary the size of the cavities. An integral retaining member is associated with the intermediate member, being connected thereto by means of a two-way hinge, whereby, when a conductor has been placed in either one of the conductor receiving cavities, the retaining member may be manually rotated to a position wherein it encloses and secures the conductor in the cavity. The connector is then intended to be placed over a second conductor, such that the second conductor is received in the other conductor receiving cavity. The connector is adapted to be compressed, by means of a compression tool, so as to substantially close the opening in the body member. The retaining member extends from the hinge, through the opening, and terminates in an end situated beyond the upper and lower arms exteriorly of the body member. The retaining member is thus able to be manually grasped by the installer at the exterior of the body member.

11 Claims, 1 Drawing Sheet

ELECTRICAL CONNECTOR

BACKGROUND OF THE INVENTION

1. Field of the Invention

The invention broadly pertains to electrical connectors for wire or cable conductors. More specifically, the invention relates to a compression-type electrical connector for connecting a first conductor to a second conductor in an electrical power distribution system. The invention finds particular application in establishing a tap connection to provide a branch current from a continuous run main power cable. An electrical connector of the aforesaid type is typically adapted to receive a tap conductor, to engage a continuous run conductor, and to be compressed by means of a crimping tool to achieve the desired connection.

In order that the electrical connector may efficiently and safely be installed on the continuous run conductor, it is desirable that it possess a configuration which allows it to be easily hooked onto the run conductor. Additionally, because the run and tap conductors may be fabricated of different metals, it is desirable that the connector isolate the respective conductors from each other so as to prevent rapid galvanic corrosion. Distinctions in the conductors which may be utilized for various applications make it further desirable that the connector accommodate a range of sizes for the respective conductors. Moreover, a further desirable feature for this type of electrical connector is that the conductor members be securely frictionally held in the cavities provided to retain them. Finally, limited access to the run conductor, which is a frequent characteristic of installation conditions, makes it desirable that the electrical connector be adapted for insertion in the compression tool with one of the conductors already installed and secured therein, enabling the connector to engage the other conductor and to be compressed immediately. It is highly advantageous, therefore, that the electrical connector present positive means for securing one of the conductors during the installation process. Even further adaptability to diverse installation conditions would be provided by the securing means being capable of selectively enclosing one or the other of the conductors during installation.

The present invention accomplishes the foregoing objectives by providing an electrical connector which is specifically configured to accept a wide range of conductor sizes, which provides conductor receiving cavities characterized by frictional gripping means capable of deforming to vary the size of the cavities, which isolates the conductors from each other to prevent galvanic corrosion, which provides a manually deformable member for positively retaining a selective one of the conductors prior to compression, and prior or subsequent to insertion in a compression tool, and which is adapted to be easily and quickly applied to the other of the conductors for immediate compression.

2. Description of the Prior Art

U.S. Pat. No. 3,053,930, which issued to Mallanik et al on Sept. 22, 1962, and which is commonly owned by the assignee of the subject invention, discloses an electrical connector possessing several features similar to those of the present invention. Mallanik et al teaches an electrical connector comprising a generally C-shaped body. A central web is disposed within the interior of the body so as to form an E-shaped configuration which defines an upper and a lower cavity. A tap conductor is intended to be inserted into either of the cavities, whereupon the central web is manually bent down by the installer on top of the tap conductor to lock it in position. The connector, with the tap conductor secured therein, may then be inserted into a compression tool, hooked onto a run conductor, whereby the run conductor is received in the other remaining cavity, and then compressed.

Mallanik et al teaches the central web as being formed separate from the body of the conductor and either staked within a groove in the body (FIG. 1), or attached to the body by means of a ball and socket joint (FIG. 4). Both of the latter embodiments, comprising as they do separable body and web members, permit the web members to be formed longer than the body, so that the central web projects from both ends of the body as illustrated in FIG. 1. It is these projecting ends of the web member which are in practice manually grasped by and pushed down upon by the installer to bend the central web down on top of the conductor to be secured in the connector.

Although Mallinick et al depicts the central web as being hingedly connected to the body of the connector in FIGS. 2 and 3, the latter embodiments are unitary members, being cut from extruded bars. As such, the ends of the central webs would not project beyond the ends of the body member, but would in fact be the same length as the body member. Furthermore, the central web is located in the central space defined by the upper and lower arms of the body member and, as such, does not project beyond the arms of the body member. Consequently, the integral electrical connector having a hinged central web shown by Mallinick et al is impractical and, indeed, virtually impossible to utilize in its intended manner for the reason that the installer is unable to bend the central web down on top of the tap conductor. This is so because the installer has no way of grasping the central web, other than through the relatively restricted opening formed between the upper and lower arms of the body member, which opening, particularly for a lineman installer with gloves on, is too small for feasible installation.

The instant invention provides all of the functional benefits which are associated with the connectors of Mallinick et al while overcoming the deficiencies associated therewith.

It is also generally known in the prior art to provide an electrical connector having a body of C-shaped configuration. U.S. Pat. No. 4,087,889 to Ohba et al, U.S. Pat. No. 1,631,719 to Chandler. U.S. Pat. No. 2,930,113 to Greco and U.S. Pat. No. 3,387,080 to Dibble et al generally disclose C-shaped connecting devices wherein one or more conductors are intended to be disposed within the open cavity defined by the C-shaped connector with the connector being subsequently compressed.

The prior art further discloses electrical connectors for connecting tap and run conductors wherein the conductors are electrically and mechanically retained within a C-shaped body member by means of toggle blocks. For example, U.S. Pat. No. 4,734,062 to Goto, which issued on Mar. 29, 1988, shows an electrical connector comprising a C-shaped body member which defines channels dimensioned to receive a range of sizes of conductors. Once the conductors which are to be connected are placed in the body member, hingedly connected toggle blocks are positioned in the body member. The toggle blocks are intended to be forced into the body member, thereby compressing the conductors in their respective channels and providing an electrical interconnection between same. A similar device is disclosed in U.S. Pat. No. 4,723,921, which issued to Pooley on Feb. 9, 1988.

A further variety of tap and run electrical connectors known in the prior art are of the H-shaped configuration. U.S. Pat. No. 3,546,366 to Toedtman, which issued on Dec. 8, 1970, for instance, shows a compressible electrical connector having an H-shaped body wherein a pair of arms and an intervening partition define conductor receiving recesses. Each of the recesses is provided with ribs which deform under pressure to accommodate the conductor size and configuration. A tab member is attached to each end of one of the arms for pivotable movement by means of a compression tool into position over a respective conductor disposed in the associated recess. Portions of the tab members mate with the opposite arm when the tab is in the compressed state.

Similarly, Levinsky. U.S. Pat. No. 3,354,517 of Nov. 28, 1967, discloses a compressible connector of H-shape configuration formed by a pair of side walls and an intermediate connecting web portion which together define major cable accommodating recesses. A reentrant recess is provided in each of the side walls in the web area for receiving endwise wires and conductors.

U.S. Pat. No. 3,236,938 to Toedtman, bearing an issue date of Feb. 22, 1966, teaches an H-shaped compressible connector wherein one of the arms of the connector body is provided at its ends with a bendable tab. The tabs are adapted to be bent inwardly, as by means of the fingers, toward the other arm of the connector body.

U.S. Pat. No. 3,235,654, which issued to Eldridoe, Jr. on Feb. 15, 1966, similarly discloses an H-shaped connector. As illustrated therein, an end of one arm of the body member is provided with a bendable tab (FIG. 1), and, additionally, the opposite end of the other arm of the body member may be provided with such a tab (FIG. 3).

Finally, Toedtman, U.S. Pat. No. 3,156,764 of Nov. 10, 1964, is directed to an H-shaped compressible electrical connector characterized by bendable tabs at the ends of one of the arms of the body, and by deformable ribs which project from the body into the conductor receiving recesses.

The prior art fails to teach or suggest a compressible electrical connector including an integral E-shaped body member provided with a central movable retaining member which projects beyond and is accessible from outside of the cavity defined by the body member, and which may be selectively bent over a desired one of plural conductor receiving cavities to retain and isolate a conductor located therein.

SUMMARY OF THE INVENTION

The invention pertains to an electrical connector for connecting a first conductor to a second conductor. The electrical connector comprises a body member of generally E-shaped configuration and being of one-piece construction, including a main body portion which is associated with an upper arm, a lower arm, and an intermediate member. The upper and lower arms terminate in ends, between which extends an opening communicating with the interior of the body member. The intermediate member extends from the main body portion toward the opening, and is located generally centrally between the upper and lower arms. The intermediate member terminates in a distal end located in the interior of the body member. The main body portion, together with the upper arm and the intermediate member define a first conductor receiving cavity in the interior of the body member. Similarly, the main body portion, together with the lower arm and the intermediate member, define a second conductor receiving cavity in the interior of the body member. Each of the conductor receiving cavities is adapted to receive a conductor oriented longitudinally therein. A plurality of deformable ribs project from the main body portion into each of the conductor receiving cavities.

A retaining member is connected at one of its ends to the distal end of the intermediate member, being connected thereto by means of an integral two-way hinge which allows the retaining member to be rotated toward either the upper or lower arm. Rotation of the retaining member in this manner results in its being brought into a position where it effectively encloses and secures a conductor that is located within the conductor receiving cavity which is associated with the arm toward which the retaining member is moved. The retaining member extends from the hinge and through the opening defined between the upper and lower arms. It terminates in an end situated beyond the upper and lower arms exteriorly of the body member.

The electrical connector is intended to be utilized by an installer manually positioning a first conductor longitudinally within a desired one of the conductor receiving cavities. While holding the connector within his hand, the installer, utilizing the fingers of the same hand, manually grasps the retaining member exteriorly of the body member and rotate the retaining member upwardly or downwardly toward the arm which is associated with the cavity containing the conductor so as to secure the conductor within the cavity. The fact that the retaining member end is located exteriorly of the body member allows such end to be easily grasped by the installer without the need for inserting fingers, objects or the like through the opening leading into the interior of the body member. The connector is then intended to be inserted into a compression tool and positioned over a second conductor, so that the second conductor is longitudinally positioned within the other conductor receiving cavity. The connector is then compressed, by means of the tool, causing the upper and lower arms to be brought together, and the opening between them closed.

DESCRIPTION OF THE PREFERRED EMBODIMENT

Figure 1:
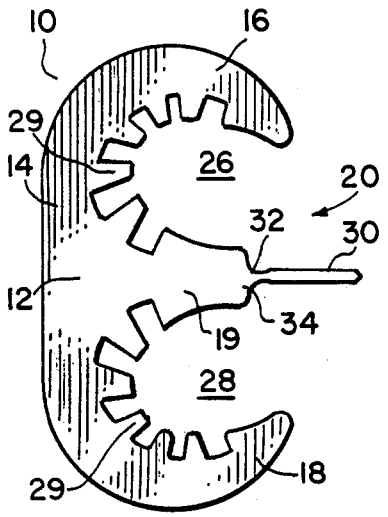
FIG. 1 is a side plan view of the electrical connector of the present invention.
Figure 3:
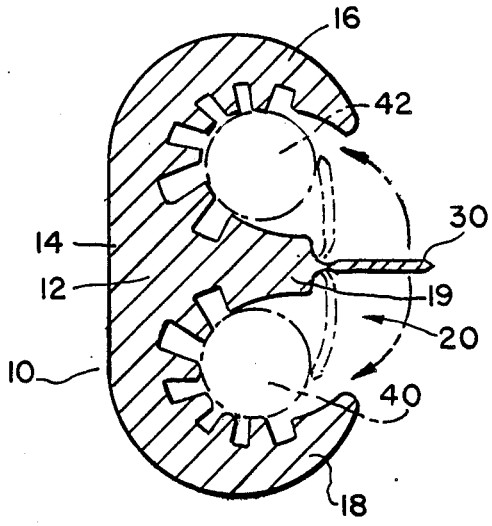
FIG. 3 is a side cross-sectional view of the electrical connector of FIG. 1, with the retaining member being shown in phantom as it appears after it has been manually bent toward a selective one of the conductor receiving cavities provided in the body of the connector.

With reference to the drawing, and with particular reference to FIGS. 1 and 3, the invention pertains to an electrical connector, indicated generally at 10. The electrical connector 10 comprises a connector body member 12 of generally E shaped configuration. The body member 12 is defined by a main body portion 14, upper arm 16, lower arm 18, and intermediate member 19. An opening 20 extends between the upper and lower arms. Intermediate member 19 extends from the main body portion 14 toward the opening 20, being located generally centrally between the upper and lower arms.

Intermediate member 19 is somewhat enlarged and, together with upper arm 16, defines an upper conductor receiving cavity 26, and together with lower arm 18 defines a lower conductor receiving cavity 28. The main body portion and the upper and lower arms are dimensioned so that the conductor receiving cavities formed thereby are capable of accommodating a wide range of conductor sizes. Additionally, the inner surface of each of the conductor receiving cavities, including a portion of the intermediate member, is formed with a plurality of deformable ribs 29, which project from the body member into the respective cavities 26 and 28. Such ribs allow even further variance in the size of the conductor receiving cavities in that they ar adapted to deform under pressure, as when the body member is compressed by means of the appropriate tool around a pair of conductor members disposed in the cavities.

A retaining member 30 is connected by means of a two-way hinge 32 to the terminal end 34 of the intermediate member 19. It is important to note that the retaining member extends from the hinge, through the opening 20, and beyond the upper and lower arms of the body member. It is thus apparent that the retaining member may be effortlessly manually grasped by an installer's fingers entirely from outside the body member, and thus does not require the installer to manipulate his fingers, or anything else for that matter, through the opening 20.

Figure 2:
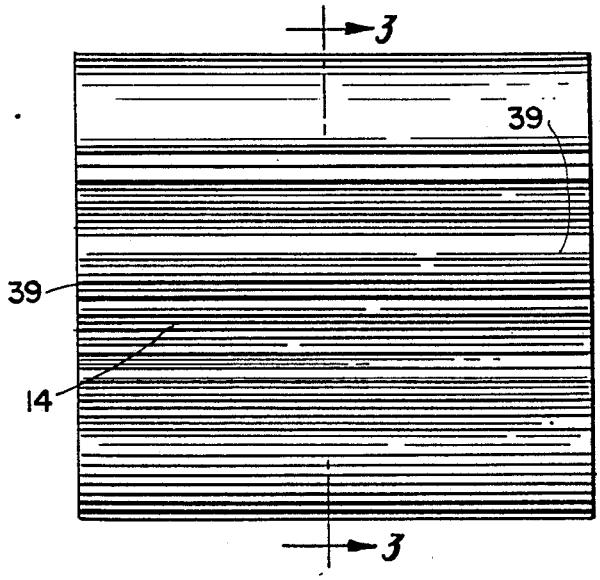
FIG. 2 is a rear plan view of the electrical connector of FIG. 1.

The body member 12, together with the integral retaining member 30, is preferably cut as an integral member from an extruded aluminum bar, aluminum being the preferred material due to its ability to resist galvanic corrosion. The side edges 39 of the body member, as shown in FIG. 2, are therefore parallel and planar, with no portion of the connector projecting beyond the side edges.

In operation, a tap conductor 40, shown in phantom in FIG. 3, is positioned by the installer in the lower conductor receiving cavity 28. While holding the electrical connector in one hand, the installer, using the fingers of the same hand, contacts the retaining member 30 and rotates it downwardly around the hinge 32 toward the lower arm 18 and into the cavity 28 in the interior of the body member. In its fully rotated position, as shown in phantom in FIG. 3, the retaining member extends into the lower conductor receiving cavity, and encloses and secures the tap conductor therein.

The electrical connector, together with the secured tap conductor, is then intended to be inserted into a suitable compression tool (not shown) and hooked onto a run conductor. As illustrated in FIG. 3, the electrical connector is adapted to engage run conductor 42 through the opening 20 between the arms of the body member so that the run conductor is received within the upper conductor receiving cavity 26. The electrical connector may then be immediately compressed by means of the tool so that the arms 16 and 18 are brought toward each other, closing the opening 20. When the connector is compressed, the ribs 29 in the conductor receiving cavities deform under the compressive pressure, the degree of deformation depending upon the size of the conductors. The connector is thus able to accommodate diverse sizes of conductors in that deformation of the ribs will allow the particular conductor to be properly accommodated in the cavity. The ribs serve the additional function of frictionally engaging the respective conductors during the installation process and thereby enhance the installation procedure.

The two-way hinge 32 of the retaining member permits the retaining member to alternatively be manually rotated upwardly in the manner previously described so as to be brought toward the upper conductor receiving cavity so that it might enclose and retain a conductor contained therein. It is apparent that the latter feature, together with accessability of the retaining member exteriorly of the body member improves and expands the circumstances under which the connector may be successfully installed.

It can be seen, therefore, that the electrical connector of the present invention is characterized by a unique retaining member 30 which serves to secure the tap conductor in position prior to compression, and an intermediate member which separates the tap and run conductors from each other. Isolation of the two conductors, as provided for by the intermediate member 19, deters galvanic corrosion in instances where the tap and run conductors are respectively formed of different metals. Moreover, the subject one-piece electrical connector is uniquely adapted to be fabricated from an integral extrusion, and is capable of accepting a wide range of conductor sizes. The present electrical connector is easily operated and installed in the field by a lineman using only one hand and under conditions of limited access.

Although the invention has been described herein in conjunction with a preferred embodiment, it should be understood that various modifications and additions may be made to the invention without departing from the spirit and scope of the invention as defined by the appended claims.

What is claimed is:

1. An electrical connector comprising a body member of substantially E-shaped configuration, said body member being defined by a main body portion, an upper arm, a lower arm, and an intermediate member, said upper and lower arms each terminating in an end, an opening extending between said ends of said upper and lower arms, said opening communicating with the interior of said body member, said intermediate member extending from said main body portion toward said opening and terminating in a distal end, said main body portion, said upper arm and said intermediate member together defining an upper conductor receiving cavity, said main body portion, said lower arm and said intermediate member together defining a lower conductor receiving cavity, each of said conductor receiving cavities being adapted to receive a conductor positioned longitudinally in said electrical connector, and at least one integral retaining member connected at one end to said distal end of said intermediate member, said retaining member projecting through said opening and terminating beyond said upper and lower arms, said retaining member being adapted to be manually grasped and rotated toward either one of said upper and lower arms so as to retain a conductor which is positioned in the conductor receiving cavity associated with the arm toward which said retaining member is rotated.

2. The electrical connector recited in claim 1, wherein a plurality of rib members project from said main body member into each of said conductor receiving cavities, said rib members being adapted to deform to vary the size of said conductor receiving cavities.

3. The electrical connector recited in claim 1, wherein said body member, said intermediate member and said retaining member are fabricated from an integral extrusion.

4. The electrical connector recited in claim 3, wherein said extrusion is formed of aluminum.

5. The electrical connector recited in claim 1, wherein said body member is deformable, the arms of said body member being adapted to be brought toward each other when said body member is compressed.

6. The electrical connector recited in claim 1, wherein said retaining member is connected to said intermediate member by means of an integral two-way hinge.

7. An electrical connector comprising an integral, deformable body member of substantially E-shaped configuration and including a main body portion, an upper arm, a lower arm, and an intermediate member, said upper and lower arms each terminating in an end, an opening extending between said ends of said upper and lower arms, said opening communicating with the interior of said body member, said main body portion having an interior surface facing said opening, said intermediate member extending from said interior surface toward said opening and terminating inside of said opening in a distal end located in said interior of said body member, said intermediate member being located generally centrally between said upper and lower arms, said main body portion, said upper arm and said intermediate member together defining an upper conductor receiving cavity located above said intermediate member, said main body portion, said lower arm, and said intermediate member together defining a lower conductor receiving cavity located below said intermediate member, each of said conductor receiving cavities being adapted to receive a conductor positioned longitudinally in said body member, a plurality of rib members projecting from said interior surface into each of said conductor receiving cavities, said rib members being adapted to contact said conductors and to deform in order to vary the size of said conductor receiving cavities, and an integral retaining member hingedly connected by means of a two-way hinge to said distal end of said intermediate member, said retaining member projecting through said opening and terminating beyond said upper and lower arms exteriorly of said body member, said retaining member being adapted to be manually grasped from outside said body member and rotated around said hinge toward either one of said upper and lower arms so as to retain a conductor which is positioned in the conductor receiving cavity associated with the arm toward which said retaining member is rotated.

8. The electrical connector recited in claim 7, wherein said body member, said intermediate member and said retaining member are cut from an aluminum extrusion.

9. The electrical connector recited in claim 7, wherein said body member is deformable, the ends of said arms being adapted to be brought toward each other when said upper and lower arms are compressed.

10. A method of using an electrical connector characterized by an integral generally E-shaped body member having a main body portion, upper and lower arms, and an intermediate member disposed between said upper and lower arms, an opening extending between said upper and lower arms and communicating with the interior of said body member, said body member, said upper arm and said intermediate member defining an upper conductor receiving cavity, said body member, said lower arm and said intermediate member defining a lower conductor receiving cavity, a retaining member integrally and hingedly connected at one end to said intermediate member, said retaining member terminating in an end located exteriorly of said body member, said method comprising the steps of:

(a) manually positioning a first conductor longitudinally within one of said conductor receiving cavities;

(b) manually grasping said retaining member exteriorly of said body member;

(c) manually rotating said retaining member toward the arm with which said one of said conductor receiving cavities is associated;

(d) manually placing said connector on a second conductor so that said second conductor is longitudinally disposed within the other of said conductor receiving cavities; and (e) compressing said connector by means of a compression tool so as to bring said upper and lower arms together and closing said opening between said arms.

11. The method recited in claim 10 further comprising the step of manually placing said connector, with said first conductor secured therein, into said compression tool prior to placing said connector on said second conductor.

* * * * *